US007229736B2

(12) United States Patent
Moudry et al.

(10) Patent No.: US 7,229,736 B2
(45) Date of Patent: Jun. 12, 2007

(54) LIQUID ELECTROPHOTOGRAPHIC TONERS COMPRISING AMPHIPATHIC COPOLYMERS HAVING ACIDIC OR BASIC FUNCTIONALITY AND WAX HAVING BASIC OR ACIDIC FUNCTIONALITY

(75) Inventors: Ronald J. Moudry, Woodbury, MN (US); Charles W. Simpson, Lakeland, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 399 days.

(21) Appl. No.: 10/978,635

(22) Filed: Oct. 31, 2004

(65) Prior Publication Data

US 2006/0093954 A1 May 4, 2006

(51) Int. Cl.
*G03G 9/00* (2006.01)

(52) U.S. Cl. ..... 430/115; 430/114; 430/137.22

(58) Field of Classification Search ..... 430/115, 430/114, 137.22

See application file for complete search history.

(56) References Cited

U.S. PATENT DOCUMENTS

| | | | |
|---|---|---|---|
| 4,413,048 | A | 11/1983 | Landa |
| 5,061,587 | A | 10/1991 | Tsubuko et al. |
| 5,364,722 | A | 11/1994 | Tanikawa et al. |
| 5,364,724 | A | 11/1994 | Mahabadi et al. |
| 5,554,476 | A | 9/1996 | Landa et al. |
| 5,635,325 | A | 6/1997 | Inaba et al. |
| 5,741,617 | A | 4/1998 | Inaba et al. |
| 5,886,067 | A | 3/1999 | Li et al. |
| 5,935,751 | A | 8/1999 | Matsuoka et al. |
| 5,958,642 | A | 9/1999 | Takagi et al. |
| 5,998,080 | A | 12/1999 | Ohno et al. |
| 6,002,903 | A | 12/1999 | Hayase et al. |
| 6,083,654 | A | 7/2000 | Lin |

(Continued)

FOREIGN PATENT DOCUMENTS

| | | |
|---|---|---|
| EP | 1396762 | 8/2003 |

(Continued)

OTHER PUBLICATIONS

Commonly assigned U.S. Appl. No. 10/881,637, filed on Jun. 30, 2004, entitled "Drying Process for Toner Particles Useful in Electrography," in the name of Chou et al.

(Continued)

*Primary Examiner*—Mark A. Chapman
(74) *Attorney, Agent, or Firm*—Kagan Binder, PLLC

(57) ABSTRACT

The invention provides liquid electrographic toner compositions comprising a liquid carrier having toner particles dispersed in the liquid carrier. The liquid carrier has a Kauri-Butanol number less than about 30 mL. The toner particles comprise polymeric binder comprising at least one amphipathic copolymer comprising one or more S material portions and one or more D material portions. The toner composition additionally comprises a wax component associated with the toner particle, wherein the wax component and the amphipathic copolymer each comprise at least one of a Lewis acid and a Lewis base pair in an amount sufficient to form weak, reversible intermolecular non-covalent bonds resulting from acid/base interactions between the wax component and the amphipathic copolymer.

These toner particles can exhibit excellent final image durability characteristics, and can also provide toner compositions that provide excellent images at low fusion temperatures on a final image receptor.

21 Claims, 1 Drawing Sheet

Effect of Wax Additives on Fusing Performance of Liquid Inks

U.S. PATENT DOCUMENTS

| | | | |
|---|---|---|---|
| 6,103,781 | A | 8/2000 | Li et al. |
| 6,117,605 | A | 9/2000 | Chiba |
| 6,136,490 | A | 10/2000 | Ogawa et al. |
| 6,153,347 | A | 11/2000 | Kabai et al. |
| 6,203,959 | B1 | 3/2001 | Tanikawa et al. |
| 6,255,363 | B1 | 7/2001 | Baker et al. |
| 6,331,372 | B1 | 12/2001 | Livengood et al. |
| 6,447,970 | B1 | 9/2002 | Matsunaga et al. |
| 6,447,971 | B2 | 9/2002 | Takezawa et al. |
| 6,475,688 | B1 | 11/2002 | Tamura et al. |
| 6,492,083 | B1 | 12/2002 | Livengood et al. |
| 6,506,532 | B2 | 1/2003 | Akai et al. |
| 6,541,174 | B1 | 4/2003 | Tanikawa et al. |
| 6,546,221 | B2 | 4/2003 | Baker et al. |
| 6,649,316 | B2 | 11/2003 | Baker et al. |
| 6,656,653 | B2 | 12/2003 | Mitsuhashi et al. |
| 6,713,221 | B2 | 3/2004 | Kada et al. |
| 2002/0197552 | A1 | 12/2002 | Baker et al. |
| 2004/0091805 | A1 | 5/2004 | Qian et al. |
| 2004/0091806 | A1 | 5/2004 | Qian et al. |
| 2004/0091807 | A1 | 5/2004 | Qian et al. |
| 2004/0091808 | A1 | 5/2004 | Qian et al. |
| 2004/0091809 | A1 | 5/2004 | Qian et al. |
| 2004/0142270 | A1 | 7/2004 | Qian et al. |

FOREIGN PATENT DOCUMENTS

| | | |
|---|---|---|
| EP | 1422572 | 11/2003 |
| EP | 1553459 | 12/2004 |

OTHER PUBLICATIONS

Commonly assigned U.S. Appl. No. 10/880,799, Filed on Jun. 30, 2004, entitled "Extrusion Drying Process for Toner Particles Useful in Electrography," in the name of Moudry et al.

Commonly assigned U.S. Appl. No. 10/978,703, filed Oct. 31, 2004, entitled "Liquid Toners Comprising Amphipathic Copolymeric Binder and Dispersed Wax for Electrographic Applications," in the name of Simpson et al.

Commonly assigned U.S. Appl. No. U.S. Appl. No. 10/978,697, filed Oct. 31, 2004, entitled "Dry Toner Comprising Entrained Wax," in the name of Simpson et al.

Commonly assigned U.S. Appl. No. U.S. Appl. No. 10/978,836, filed Oct. 31, 2004, entitled "Dry Toner Comprising Wax," in the name of Herman et al.

Commonly assigned U.S. Appl. No. U.S. Appl. No. 10/978,688, filed Oct. 31, 2004, entitled "Dry Toner Blended with Wax," in the name of Stulc et al.

11 pgs. "The influence of rheology and molecular architecture on the fusing behavior of toners," DeMejo et al, SPIE, vol. 1253 Hard Copy and Printing Materials, Media, and Process (1990), pp. 85-95.

4 pgs. "Rheological Study on Fixing Polyester Resin Toners," Satoh et al, Journal of Imaging Science, vol. 35, No. 6, Nov./Dec. 1991, pp. 373-376.

2 pgs. Clariant Gmbh, Sep. 2003 News Bulletin, "Toner Waxes".

Figure 1. Effect of Wax Additives on Fusing Performance of Liquid Inks
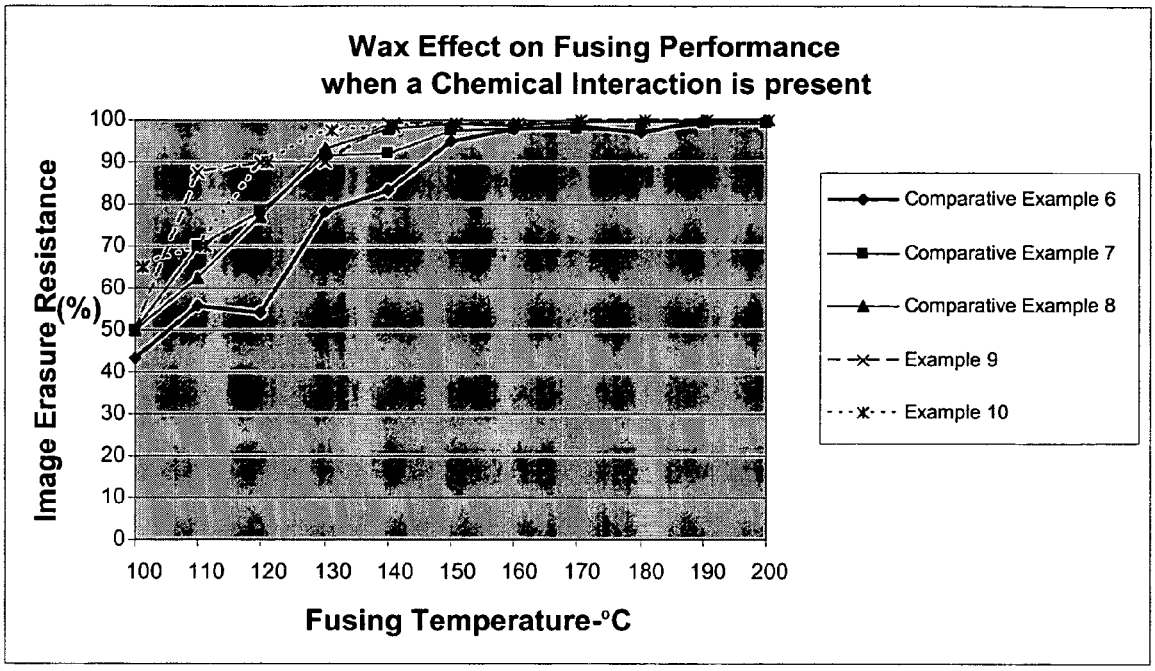

LIQUID ELECTROPHOTOGRAPHIC TONERS COMPRISING AMPHIPATHIC COPOLYMERS HAVING ACIDIC OR BASIC FUNCTIONALITY AND WAX HAVING BASIC OR ACIDIC FUNCTIONALITY

FIELD OF THE INVENTION

The present invention relates to liquid toner compositions having utility in electrography. More particularly, the invention relates to liquid toner compositions comprising an acidic or basic amphipathic copolymer binder and a basic or acidic wax component that is associated with the amphipathic copolymer by reversible intermolecular non-covalent bonds.

BACKGROUND OF THE INVENTION

In electrophotographic and electrostatic printing processes (collectively electrographic processes), an electrostatic image is formed on the surface of a photoreceptive element or dielectric element, respectively. The photoreceptive element or dielectric element can be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983, 4,321,404, and 4,268,598.

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which can also be referred to as "light," can include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer can be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes can also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

A single-pass electrophotographic process for developing multiple color images is also known and can be referred to as a tandem process. A tandem color imaging process is discussed, for example in U.S. Pat. Nos. 5,916,718 and 5,420,676. In a tandem process, the photoreceptor accepts color from developer stations that are spaced from each other in such a way that only a single pass of the photoreceptor results in application of all of the desired colors thereon.

Alternatively, electrophotographic imaging processes can be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227–252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1–1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68–74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3–10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

The art continually searches for improved liquid toner compositions that are storage stable and that produce high quality, durable images on a final image receptor.

SUMMARY OF THE INVENTION

The present invention relates to liquid electrographic toner compositions comprising a liquid carrier having toner particles and at least one wax component associated with the toner particle. The liquid carrier has a Kauri-Butanol number less than about 30 mL. The toner particles comprise polymeric binder comprising at least one amphipathic copolymer comprising one or more S material portions and one or more D material portions. The wax component and the amphipathic copolymer each comprise at least one of a Lewis acid and a Lewis base pair in an amount sufficient to form weak, reversible intermolecular non-covalent bonds resulting from acid/base interactions between the wax component and the amphipathic copolymer.

For purposes of the present invention, the term "associated with" means that the wax component has weak, reversible intermolecular non-covalent bonds with the toner particle, but is not covalently bonded to the toner particle. Preferably, the wax component is present in an amount of from about 1% to about 10% by weight based on toner particle weight.

Surprisingly, toner compositions comprising wax associated with the polymeric binder as described herein provides toners that can exhibit excellent final image durability characteristics, and can also provide a toner composition that provides excellent images at low fusion temperatures on a final image receptor. The images that are formed from toner compositions of the present invention can exhibit excellent durability and erasure resistance properties. Even though the wax is not covalently bonded to the toner particle, the wax surprisingly does not migrate from the toner particle under conditions of use in a manner that would adversely affect triboelectric charging of the toner particle or that would contaminate the photoreceptor, intermediate transfer element, fuser element, or other surfaces critical to the electrophotographic process.

While not being bound by theory, it is believed that by providing a wax component with one half of an acid/base pair, and an amphipathic copolymer with the other half of an acid/base pair, the resulting acid/base interaction provides a toner composition having wax components that are durably associated with the toner particle without the formation of covalent bonds.

BRIEF DESCRIPTION OF THE DRAWINGS

FIG. 1 is a chart showing the effect of wax additives on the fusing performance of liquid inks.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

The toner particles of the liquid toner composition comprise a polymeric binder that comprises an amphipathic copolymer. As used herein, the term "amphipathic" refers to a copolymer having a combination of portions having distinct solubility and dispersibility characteristics in a desired liquid carrier that is used to make the organosol and/or used in the course of preparing the liquid toner particles. Preferably, the liquid carrier is selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier. A Lewis acid-functionality or a Lewis base-functionality may be provided in either or both of the S material portion and the D material portion of the amphipathic copolymer.

As noted above, the toner particles as provided herein comprise at least one wax component associated with the polymeric binder via weak attractive forces arising from the electron donor-acceptor interaction between a Lewis acid and a Lewis base. This attractive force is described in Allan F. M. Barton, *Handbook of Solubility and Other Cohesion Parameters* (CRC Press: Boca Raton, Fla., 1991 pp. 71–72).

In one embodiment, the wax comprises at least one acidic functionality and the amphipathic copolymer comprises at least one basic functionality, wherein the acidic and basic functionalities are capable of interacting with the opposite member of the acid/base pair to provide the weak attractive force as described herein. Likewise in another embodiment, the wax comprises at least one basic functionality and the amphipathic copolymer comprises at least one acidic functionality, wherein the acidic and basic functionalities are capable of interacting with the opposite member of the acid/base pair to provide the weak attractive force as described herein. Preferred acidic functionalities for either the wax or the amphipathic copolymer are selected from carboxylic acid and sulfonic acid functionalities. Preferred basic functionalities for either the wax or the amphipathic copolymer are selected from amine, alkylamine, dialkylamine, piperidine, hydroxy, pyridine, pyridine, and pyrrolidone functionalities.

Preferably, the wax has a melting temperature of from about 60° C. to about 150° C., and preferably has a molecular weight of from about 10,000 to 1,000,000, and more preferably from about 50,000 to about 500,000 Daltons. Examples of types of waxes that may be used include acid or base functional waxes selected from polypropylene wax, silicone wax, fatty acid ester wax, and metallocene wax. Optionally, the wax may be insoluble in the liquid carrier. In such an embodiment, the absolute difference in Hildebrand solubility parameters between the wax and the liquid carrier is preferably greater than about 2.8 $MPa^{1/2}$, more preferably greater than about 3.0 $MPa^{1/2}$, and more preferably greater than about 3.2 $MPa^{1/2}$.

In preferred embodiments, the copolymer is polymerized in situ in the desired organic liquid carrier, as this yields substantially monodisperse copolymeric particles suitable for use in toner compositions. The resulting organosol is then preferably mixed with at least one visual enhancement additive and optionally one or more other desired ingredients to form a liquid toner. During such combination, ingredients comprising the visual enhancement particles and the copolymer will tend to self-assemble into composite particles having solvated (S) portions and dispersed (D) portions. Specifically, it is believed that the D material of the copolymer will tend to physically and/or chemically interact with the surface of the visual enhancement additive, while the S material helps promote dispersion in the carrier.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier can be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material can also be referred to herein as a "graft stabilizer." The core/shell structure of the binder particles tends to be retained when the particles are dried when incorporated into liquid toner particles.

The solubility of a material, or a portion of a material such as a copolymeric portion, can be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519–557 (1989), and for many commercially available polymers in Barton, A. F. M., *Handbook of Polymer-Liquid Interaction Parameters and Solubility Parameters,* CRC Press, Boca Raton, Fla., (1990).

The degree of solubility of a material, or portion thereof, in a liquid carrier can be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S material portion(s) of the copolymer and the liquid carrier is less than 3.0 $MPa^{1/2}$. In a particularly preferred embodiment of the present invention, the absolute difference between the respective Hildebrand solubility parameters of the S material portion(s) of the copolymer and the liquid carrier is from about 2 to about 3.0 $MPa^{1/2}$. Additionally, it is also preferred that the absolute difference between the respective Hildebrand solubility parameters of the D material portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D material portion(s) is at least about 0.4 $MPa^{1/2}$, more preferably at least about 1.0 $MPa^{1/2}$. Because the solubility of a material can vary with changes in temperature, such solubility parameters are preferably determined at a desired reference temperature such as at 25° C.

Those skilled in the art understand that the Hildebrand solubility parameter for a copolymer, or portion thereof, can be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters,* CRC Press, Boca Raton, p 12 (1990). The magnitude of the Hildebrand solubility parameter for polymeric materials is also known to be weakly dependent upon the weight average molecular weight of the polymer, as noted in Barton, pp 446–448. Thus, there will be a preferred molecular weight range for a given polymer or portion thereof in order to achieve desired solvating or dispersing characteristics. Similarly, the Hildebrand solubility parameter for a mixture can be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrographic toner and the Hildebrand solubility parameters and glass transition temperatures (based on their high molecular weight homopolymers) for some common monomers used in synthesizing organosols.

TABLE I

Hildebrand Solubility Parameters

Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).

*Polymer Handbook, 3rd Ed., J. Brandrup E. H. Immergut, Eds., John Wiley, NY, pp. VII/209–277 (1989). The $T_g$ listed is for the homopolymer of the respective monomer.

**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous liquid carrier can be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred liquid carriers include branched paraffinic solvent blends such as Isopar™ G, Isopar™ H, Isopar™ K, Isopar™ L, Isopar™ and Isopar™ V (available from Exxon Corporation, N.J.), and most preferred carriers are the aliphatic hydrocarbon solvent blends such as Norpar™ 12, Norpar™ 13 and Norpar™ 15 (available from Exxon Corporation, N.J.). Particularly preferred liquid carriers have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization can be carried out in any appropriate solvent, and a solvent exchange can be carried out to provide the desired liquid carrier for the toner composition.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The weight average molecular weight of the amphipathic copolymer of the present invention can vary over a wide range, and can impact imaging performance. The polydispersity of the copolymer also can impact imaging and transfer performance of the resultant liquid toner material. Because of the difficulty of measuring molecular weight for an amphipathic copolymer, the particle size of the dispersed copolymer (organosol) can instead be correlated to imaging and transfer performance of the resultant liquid toner material. Generally, the volume mean particle diameter ($D_v$) of the dispersed graft copolymer particles, determined by laser diffraction particle size measurement, should be in the range 1–100 microns, more preferably 5–75 microns, even more preferably 10–50 microns, and most preferably 20–30 microns.

In addition, a correlation exists between the molecular weight of the solvatable or soluble S material portion of the graft copolymer, and the imaging and transfer performance of the resultant toner. Generally, the S material portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S material portion of the copolymer below 15, more preferably below 5, most preferably below 2.5. It is a distinct advantage of the present invention that copolymer particles with such lower polydispersity characteristics for the S material portion are easily made in accordance with the practices described herein, particularly those embodiments in which the copolymer is formed in the liquid carrier in situ.

The relative amounts of S and D material portions in a copolymer can impact the solvating and dispersibility characteristics of these portions. For instance, if too little of the S material portion(s) are present, the copolymer can have too little stabilizing effect to sterically-stabilize the organosol with respect to aggregation as might be desired. If too little of the D material portion(s) are present, the small amount of D material can be too soluble in the liquid carrier such that there can be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1/20 to 20/1, preferably 1/1 to 15/1, more preferably 2/1 to 10/1, and most preferably 4/1 to 8/1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, N.Y., pp 54–55 (1992).

In the practice of the present invention, values of $T_g$ for the D or S material portion of the copolymer were determined using the Fox equation above, although the $T_g$ of the copolymer as a whole can be determined experimentally using e.g., differential scanning calorimetry. The glass transition temperatures ($T_g$'s) of the S and D material portions can vary over a wide range and can be independently selected to enhance manufacturability and/or performance of the resulting liquid toner particles. The $T_g$'s of the S and D material portions will depend to a large degree upon the type of monomers constituting such portions. Consequently, to provide a copolymer material with higher $T_g$, one can select one or more higher Tg monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in liquid toner applications, the copolymer $T_g$ preferably should not be too low or else receptors printed with the toner can experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking issues, yet not so high as to require fusing temperatures approaching the temperatures at which the final image receptor can be damaged, e.g. approaching the autoignition temperature of paper used as the final image receptor. Desirably, therefore, the copolymer has a $T_g$ of 0°–100°C., more preferably 20°–90° C., most preferably 40°–80° C.

For copolymers in which the D material portion comprises a major portion of the copolymer, the $T_g$ of the D material portion will dominate the $T_g$ of the copolymer as a whole. For such copolymers useful in liquid toner applications, it is preferred that the $T_g$ of the D material portion fall in the range of 30°–105° C., more preferably 40°–95° C., most preferably 60°–85° C., since the S material portion will generally exhibit a lower $T_g$ than the D material portion, and a higher $T_g$ D material portion is therefore desirable to offset the $T_g$ lowering effect of the S material portion, which can be solvatable. Blocking with respect to the S material portion material is not as significant an issue inasmuch as preferred copolymers comprise a majority of the D material portion material. Consequently, the $T_g$ of the D material portion material will dominate the effective $T_g$ of the copolymer as a whole. However, if the $T_g$ of the S material portion is too low, then the particles might tend to aggregate. On the other hand, if the $T_g$ is too high, then the requisite fusing temperature can be too high. Balancing these concerns, the S material portion material is preferably formulated to have a $T_g$ of at least 0° C., preferably at least 20 C., more preferably at least 40° C. It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor).

Similarly, in multi-color (or multi-pass) electrostatic printing wherein a stylus is used to generate a latent electrostatic image directly upon a dielectric receptor that serves as the final toner receptor material, a rapidly self-fixing toner film can be undesirably removed in passing under the stylus. This head scraping can be reduced or eliminated by manipulating the effective glass transition temperature of the organosol. For liquid electrographic (electrostatic) toners, particularly liquid toners developed for use in direct electrostatic printing processes, the D material portion of the organosol is preferably provided with a sufficiently high $T_g$ such that the organosol exhibits an effective glass transition temperature of from about 15° C. to about 55° C., and the D material portion exhibits a $T_g$ calculated using the Fox equation, of about 30–55° C.

In one aspect of the present invention, toner particles are provided that are particularly suitable for electrophotographic processes wherein the transfer of the image from the surface of a photoconductor to an intermediate transfer material or directly to a print medium is carried out without film formation on the photoconductor. In this aspect, the D material preferably has a $T_g$ of at least about 55° C., and more preferably at least about 65° C.

A wide variety of one or more different monomeric, oligomeric and/or polymeric materials can be independently incorporated into the S and D material portions, as desired. Representative examples of suitable materials include free radically polymerized material (also referred to as vinyl copolymers or (meth)acrylic copolymers in some embodiments), polyurethanes, polyester, epoxy, polyamide, polyimide, polysiloxane, fluoropolymer, polysulfone, combinations of these, and the like. Preferred S and D material portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case can be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl," as used herein, encompasses acryl and/or methacryl.

Free radically polymerizable monomers, oligomers, and/or polymers are advantageously used to form the copolymer in that so many different types are commercially available and can be selected with a wide variety of desired characteristics that help provide one or more desired performance characteristics. Free radically polymerizable monomers, oligomers, and/or monomers suitable in the practice of the present invention can include one or more free radically polymerizable moieties.

Preferred monomers used to form the amphipathic copolymers as described herein are C1 to C24 alkyl esters of acrylic acid and methacrylic acid. Representative examples of monofunctional, free radically polymerizable monomers include styrene, alpha-methylstyrene, substituted styrene, vinyl esters, vinyl ethers, N-vinyl-2-pyrrolidone, (meth) acrylamide, vinyl naphthalene, alkylated vinyl naphthalenes, alkoxy vinyl naphthalenes, N-substituted (meth)acrylamide, octyl(meth)acrylate, nonylphenol ethoxylate(meth) acrylate, N-vinyl pyrrolidone, isononyl(meth)acrylate, isobornyl(meth)acrylate, 2-(2-ethoxyethoxy)ethyl(meth) acrylate, 2-ethylhexyl(meth)acrylate, beta-carboxyethyl (meth)acrylate, isobutyl(meth)acrylate, cycloaliphatic epoxide, alpha-epoxide, 2-hydroxyethyl(meth)acrylate, (meth)acrylonitrile, maleic anhydride, itaconic acid, isodecyl(meth)acrylate, lauryl(dodecyl)(meth)acrylate, stearyl (octadecyl)(meth)acrylate, behenyl(meth)acrylate, n-butyl (meth)acrylate, methyl(meth)acrylate, ethyl(meth)acrylate, hexyl(meth)acrylate, (meth)acrylic acid, N-vinylcaprolactam, stearyl(meth)acrylate, hydroxy functional caprolactone ester(meth)acrylate, isooctyl (meth)acrylate, hydroxyethyl (meth)acrylate, hydroxymethyl(meth)acrylate, hydroxypropyl(meth)acrylate, hydroxyisopropyl(meth)acrylate, hydroxybutyl(meth)acrylate, hydroxyisobutyl(meth)acrylate, tetrahydrofurfuryl(meth)acrylate, isobornyl(meth)acrylate, glycidyl(meth)acrylate vinyl acetate, combinations of these, and the like.

Preferred copolymers of the present invention can be formulated with one or more radiation curable monomers or combinations thereof that help the free radically polymerizable compositions and/or resultant cured compositions to satisfy one or more desirable performance criteria. For example, in order to promote hardness and abrasion resistance, a formulator can incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state. The advantages of incorporating such monomers into the copolymer are further described in assignee's co-pending U.S. patent application filed in the name of Qian et al., U.S. Ser. No. 10/612,765, filed on Jun. 30, 2003, entitled ORGANOSOL INCLUDING HIGH Tg AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH Tg MONOMER AND LIQUID TONERS FOR ELECTROPHOTOGRAPHIC APPLICATIONS for liquid toner compositions, which are hereby incorporated by reference.

In a preferred embodiment of the present invention, the S material portion, comprises radiation curable monomers that have relatively high $T_g$ characteristics. Preferably, such monomers comprise at least one radiation curable (meth) acrylate moiety and at least one nonaromatic, alicyclic and/or nonaromatic heterocyclic moiety. Examples of preferred monomers that can be incorporated into the S material portion comprises isobornyl (meth)acrylate; 1,6-Hexanediol di(meth)acrylate; trimethyl cyclohexyl methacrylate; t-butyl methacrylate; and n-butyl methacrylate. Combinations of high $T_g$ components for use in the S material portion are specifically contemplated, together with anchor grafting groups such as provided by use of HEMA subsequently reacted with TMI.

Nitrile functionality can be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl(meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α, β-unsaturated carboxylic acid with a diol, e.g., 2-hydroxyethyl(meth)acrylate, or 2-hydroxypropyl(meth)acrylate; 1,3-dihydroxypropyl-2-(meth)acrylate; 2,3-dihydroxypropyl-1-(meth)acrylate; an adduct of an α, β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Multifunctional free radically reactive materials can also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl (meth)acrylates, and (meth)acrylated oils.

A Lewis acid-functionality or a Lewis base-functionality may be provided in either or both of the S material portion and the D material portion of the amphipathic copolymer. Preferably these functionalities are incorporated by reacting a Lewis acid or base-functional polymerizable compound as part of the polymerization reaction to form the copolymer.

Suitable Lewis acid polymerizable compounds include acrylic acid, 2-acrylamido-2-methyl propane sulfonic acid, 2-carboxyethyl acrylate, crotonic acid, itaconic acid, maleic acid, methacrylic acid, pentaerythritol dimethacrylate, styrene sulfonic acid, and 4-vinyl benzoic acid, and mixtures thereof.

Suitable Lewis base polymerizable compounds include 2-(dimethylamino)ethyl methylate, diacetone acrylamide, acrylamide, allyl alcohol, allyl amine, allyl diethylamine, allyl ethylamine, allyl dimethylamine, allyl hydroxyethyl ether, N-allyl piperidine, p-amino styrene, diallyl amine, bis-diallylamino methane, t-butylamino methacrylate, diethylaminoethyl methacrylate, diallyl methylamine, N,N-diallylmelamine, 2-dimethylaminoethyl methacrylate, dimethylaminopropyl acrylamide, 2-dimethylamino methyl styrene, 3-dimethylamino neopentyl acrylate, 2,3-dihydroxy propyl acrylate, 2-diisopropylaminoethyl methacrylate, 4-hydroxybutyl acrylate, 4-hydroxybutyl methacrylate, 2-hydroxyethyl acrylate, 2-hydroxyethyl methacrylate, 2-hydroxypropyl acrylate, 2-hydroxypropyl methacrylate, 4-hydroxy styrene, vinyl benzene alcohol, vinyl benzene dimethylamine, 2-vinyl pyridine, 4-vinyl pyridine, and N-vinyl-2-pyrrolidone.

Copolymers of the present invention can be prepared by free-radical polymerization methods known in the art, including but not limited to bulk, solution, and dispersion polymerization methods. The resultant copolymers can have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S material portion or D material portion materials, as the case can be, can be incorporated into the arms and/or the backbone.

Any number of reactions known to those skilled in the art can be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79–106, also incorporated herein by reference.

Representative examples of grafting methods also can use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

Preferably, amphipathic copolymers are prepared by first preparing an intermediate S material portion comprising reactive functionality by a polymerization process, and subsequently reacting the available reactive functionalities with a graft anchoring compound. The graft anchoring compound comprises a first functionality that can be reacted with the reactive functionality on the intermediate S material portion, and a second functionality that is a polymerizably reactive functionality that can take part in a polymerization reaction. After reaction of the intermediate S material portion with the graft anchoring compound, a polymerization reaction with selected monomers can be carried out in the presence of the S material portion to form a D material portion having one or more S material portions grafted thereto.

The preferred methodology described above accomplishes grafting via attaching an ethylenically-unsaturated isocyanate (e.g., dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S material portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl (meth)acrylate, ethyl (meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles can remain in the reaction solvent. Alternatively, the particles can be transferred in any suitable way into fresh solvent that is the same or different so long as the copolymer has solvated and dispersed phases in the fresh solvent. In either case, the resulting organosol is then converted into toner particles by mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier. In addition to the visual enhancement additive, other additives optionally can be formulated into the liquid toner composition.

The wax component can be incorporated into the toner composition at any of a number of steps in the process of preparing the toner composition. The timing of incorporation can have an effect on the physical configuration of the resulting toner particle. In one embodiment of the present invention, the wax component is present in the reaction liquid at the time of formation of the amphipathic copolymer. In this embodiment, the wax tends to be entrained in the copolymer during formation, and preferably is substantially uniformly distributed throughout the toner particle. In another embodiment, the wax is incorporated toner composition after formation of the amphipathic copolymer, but before addition of additional adjuvants or ingredients. In this embodiment, the wax tends to be partially entrained in the toner particle, with a greater portion of the wax being at the surface of the particle. In another embodiment, the wax is incorporated in the toner composition after complete assembly and formulation of the toner particles. In this embodiment, the wax tends to be associated with the polymeric binder primarily at the surface of the toner particle.

Charge directors, can be used in any liquid toner process, and particularly can be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director can be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S material portion of the graft copolymer, the composition of the organosol, the molecular weight of the organosol, the particle size of the organosol, the D/S ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive can be adjusted based on a variety of parameters to achieve the desired results for a particular application.

Any number of charge directors such as those described in the art can be used in the liquid toners or transfer assist materials of the present invention in order to impart a negative electrical charge onto the toner particles. For example, the charge director can be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt(e.g., Na) of a phosphoglyceride A preferred example of such a charge director is Emphos™ D70-30C, Witco Chemical Corp., New York. N.Y., which is a sodium salt of phosphated mono- and diglycerides.

Any number of charge directors such as those described in the art can be used in the liquid toners or transfer assist materials of the present invention in order to impart a positive electrical charge onto the toner particles. For example, the charge director can be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936. A particularly preferred positive charge director is zirconium 2-ethyl hexanoate.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Other additives can also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 3 to about 10 microns, most preferably in the range of about 1.5 to about 5 microns.

The toner compositions as described herein are highly useful in electrophotographic and electrographic processes. In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention can be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element can be either positive or negative, electrophotography as employed in the present invention is preferably carried out by dissipating charge on a positively charged photoreceptive element. A positively-charged toner is then applied to the regions in which the positive charge was dissipated using a liquid toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film can be coated or primed, e.g. to promote toner adhesion.

In electrophotographic processes, the toner composition preferably is provided at a solids content of about 1–30%. In electrostatic processes, the toner composition preferably is provided at a solids content of 3–15%.

These and other aspects of the present invention are demonstrated in the illustrative examples that follow.

EXAMPLES

1. Glossary of Chemical Abbreviations & Chemical Sources

The following abbreviations are used in the examples which follow:

AIBN: Azobisisobutyronitrile (a free radical forming initiator available as VAZO-64 from DuPont Chemical Co., Wilmington, Del.)

DBTDL: Dibutyl tin dilaurate (a catalyst available from Aldrich Chemical Co., Milwaukee, Wis.)

EA: Ethyl acrylate (available from Aldrich Chemical Co., Milwaukee, Wis.)

EMA: Ethyl methacrylate (available from Aldrich Chemical Co., Milwaukee, Wis.)

EMAAD: N-ethyl-2-methylallyamine (available from Aldrich Chemical Co., Milwaukee, Wis.)

GP 628: Amine-functional silicone wax (a PCC available from Genesee Polymer Corporation, Flint, Mich.)

HEMA: 2-Hydroxyethyl methacrylate (available from Aldrich Chemical Co., Milwaukee, Wis.)

MMA: Methyl methacrylate (Aldrich Chemical Co., Milwaukee, Wis.)

TCHMA: 3,3,5-Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

Unicid 350: Acid ethene fatty homopolymer (Baker Petrolite Polymers Division Sugar Land, Tex.)

V-601: Dimethyl 2,2'-azobisisobutyrate (a free radical forming initiator available as V-601 from WAKO Chemicals U.S.A., Richmond, Va.)

Zirconium HEX-CEM: metal soap, zirconium tetraoctoate (available from OMG Chemical Company, Cleveland, Ohio)

Technical Wax Information

| Wax Name | Available from | Chemical Structure | Melting Point ° C. | Norpar™ 12 Solubility Limit (g/100 g) |
|---|---|---|---|---|
| Silicone Wax GP-628 | Genesee Polymers, Flint, MI | Amine Functional Silicone | 60–70 | 7.03 |
| Unicid 350 | Baker Petrolite, Sugarland, TX | Carboxylic Acid | 25–92 | 2.71 |

Test Methods

The following test methods were used to characterize the polymer and toner samples in the examples that follow:

Solid Content of Solutions

In the following toner composition examples, percent solids of the graft stabilizer solutions, the organosol, and milled liquid toner dispersions were determined thermo-gravimetrically by drying in an aluminum weighing pan an originally-weighed sample at 160° C. for two to three hours, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Graft Stabilizer Molecular Weight

Various properties of the graft stabilizer have been determined to be important to the performance of the stabilizer, including molecular weight and molecular weight polydispersity. Graft stabilizer molecular weight is normally expressed in terms of the weight average molecular weight ($M_w$), while molecular weight polydispersity is given by the ratio of the weight average molecular weight to the number average molecular weight ($M_w/M_n$). Molecular weight parameters were determined for graft stabilizers with gel permeation chromatography (GPC) using tetrahydrofuran as the carrier solvent. Absolute $M_w$ was determined using a Dawn DSP-F light scattering detector (commercially obtained from Wyatt Technology Corp, Santa Barbara, Calif.), while polydispersity was evaluated by ratioing the measured $M_w$ to a value of $M_n$ determined with an Optilab DF differential refractometer detector (commercially obtained from Wyatt Technology Corp, Santa Barbara, Calif.).

Partical Size

The organosol particle size distributions were determined using a Horiba LA-920 laser diffraction particle size analyzer (commercially obtained from Horiba Instruments, Inc, Irvine, Calif.) using Norpar™ 12 fluid that contains 0.1% (w/w) Aerosol OT (dioctyl sodium sulfosuccinate, sodium salt, Fisher Scientific, Fairlawn, N.J.) surfactant. The dry toner particle size distributions were determined using a Horiba LA-900 laser diffraction particle size analyzer (commercially obtained from Horiba Instruments, Inc, Irvine, Calif.) using de-ionized water that contains 0.1% (w/w) Triton X-100 surfactant (available from Union Carbide Chemicals and Plastics, Inc., Danbury, Conn.).

In both procedures, the samples were diluted by approximately 1/500 by volume and sonicated for one minute prior to measurement. Sonication on the Horiba LA-920 was operated at 150 watts and 20 kHz. The particle size was expressed on a number-average basis in order to provide an indication of dominance of the fundamental (primary) particle size of the particles or was expressed on a volume-average basis in order to provide an indication of dominance of the coalesced primary particle aggregate size of the particles.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1–2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, nc., Hopkinton, Mass.). Unlike electrokinetic measurements based upon microelectrophoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Q/M

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% (w/w) solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 1 hour at 160° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Conventional Differential Scanning Calorimetry

Thermal transition data for synthesized toner material was collected using a TA Instruments Model 2929 Differential Scanning Calorimeter (New Castle, Del.) equipped with a DSC refrigerated cooling system (−70° C. minimum temperature limit) and dry helium and nitrogen exchange gases. The calorimeter ran on a Thermal Analyst 2100 workstation with version 8.10 B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5–10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature ($T_g$) value—values were reported from either the third or fourth heat ramp.

Graft stabilizer samples were prepared by precipitating and washing the sample in a non-solvent. The graft stabilizer samples were placed in an aluminum pan and dried in an oven at 100° C. for 1–2 hr. The organosol samples were placed in an aluminum pan and dried in an oven at 160° C. for 2–3 hr.

Liquid Ink Printing and Testing

In the following examples, toner was printed onto final image receptors using the following methodology (referred to in the Examples as the Liquid Electrophotographic Printing Method):

A light sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: a conductive rubber developer roller in contact with the OPC, liquid toner, a conductive deposition roller, an insulative foam cleaning roller in contact with developer roller surface, and a conductive skiving blade (skive) in contact with the developer roller.

The contact area between the developer roller and the OPC is referred to as the "developing nip." The developer roller and conductive deposition roller were both partially suspended in the liquid toner. The developer roller delivered liquid toner to the OPC surface, while the conductive deposition roller was positioned with its roller axis parallel to the developer roller axis and its surface arranged to be approximately 150 microns from the surface of the developer roller, thereby forming a deposition gap.

During development, the ink pumping roller supplied liquid ink to the gap between the deposition roller and the developer roller. A toner film was initially plated to the developer roller surface by applying a voltage of approximately 600 volts to the developer roller and applying a voltage of approximately 800 volts to both the deposition and metering roller. The 200 volt difference between the developer and deposition rollers caused the positively charged toner particles to migrate in the deposition nip to the surface of the developer roller. The metering roller, which is biased to approximately 800 volts, removed excess liquid from the developer roller surface.

The surface of the developer roller now contained a uniformly thick layer of toner at approximately 25% (w/w) solids. As this toner layer passed through the developing nip, toner was transferred from the developer roller to the latent image areas. The approximate 500 volt difference between the developer roller and the latent image area caused the positively charged toner particles to develop to the OPC surface. At the exit of the developing nip, the OPC contained a toner image and the developer roller contained a negative of that toner image which was then cleaned from the developer roller surface by the rotating foam cleaning roller.

The developed image on the OPC was subsequently electrostatically transferred to an Intermediate Transfer Belt (ITB) with an electrical bias in the range of −800 to −2000 volts applied to a conductive rubber roller pressing the ITB to the OPC surface. Transfer to the final image receptor was accomplished with electrostatically-assisted offset transfer by forcibly applying a conductive, biased rubber transfer roller behind the image receptor, pressing the imaged ITB between the final image receptor and a grounded, conductive metal transfer backup roller. The transfer roller is typically biased in the range of −1200 to −3000 volts.

Prints were generated, using the method as described above, using black toner to create a square block having dimensions approximately 1" wide and 6" long on an 8.5"X11" sheet of paper.

Fusing Test

The image was fixed to the final image receptor (paper) using a two station fusing unit attached to the printing device described above. The fusing unit was mounted directly above the paper exit. The fusing unit was comprised of two sets of rollers (two stations), with each set of rollers having a different coating. The imaged page was passed between each set of rollers such that for each set of rollers, one roller contacted the image surface and one contacted the backside (non-imaged side) of the page.

Both set of rollers contained silicone rubber for the base. For each set of rollers, the roller that contacted the image surface had a Shore A 10 durometer rubber base; the backup roller had a Shore A 20 durometer rubber base. The first set of rollers between which the imaged receptor passed may be set to a lower temperature than the second set and had a dimethyl siloxane coating on both rollers to alleviate offset when contacting the liquid toner. The second set of rollers between which the imaged receptor passed are capable of being set to a high temperature and were covered with a molded in place Teflon® sleeve to fuse the semi-dried liquid toner. Each roller contained a 600W/138 volt halogen lamp for a heat source. An IR probe was used to read the temperature of the top and bottom image contacting roller. Additional information is given in the chart below Summary of Fusing Conditions

| Roller set | Amount of force between the rollers | Maximum Temperature | Minimum Temperature | Fusing (Roller) Speed |
|---|---|---|---|---|
| 1st pair | 20 PSI | 200° C. | 100° C. | 4.9 in/sec |
| 2nd pair | 23 PSI | 200° C. | 100° C. | 4.9 in/sec |

Both rollers sets were the set at the same temperature in 10° C. increments from 100° C. to 200° C. for each ink evaluated. If the fusing lamps overheated the rollers, they were allowed to cool down until the testing temperature was reached. If the rollers were too cool, they were allowed to warm up and cool back down to the evaluation temperature. If conditions were run which exhibited offset, the rollers were cleaned with Norpar™ 12 before the next temperature setting was run.

All fused images were subjected to image durability testing, which is described below.

Fused Image Erasure Resistance:

In these experiments, the evaluation took place as soon as possible after fusing (typically within 5 minutes). This test is used to determine image durability when a printed image is subjected to abrasion from materials such as other paper, linen cloth, and pencil erasers.

In order to quantify the resistance of the printed ink to erasure forces after fusing, an erasure test has been defined. This erasure test consists of using a device called a Crockmeter to abrade the inked and fused areas with a linen cloth loaded against the ink with a known and controlled force. A standard test procedure followed generally by the inventors is defined in ASTM #F 1319-94 (American Standard Test Methods). The Crockmeter used in this testing was an AATCC Crockmeter Model CM1 manufactured by Atlas Electric Devices Company, Chicago, Ill. 60613.

A piece of linen cloth is affixed to the Crockmeter probe; the probe is placed onto the printed surface with a controlled force and caused to slew back and forth on the printed surface a prescribed number of times (in this case, 10 times by the turning of a small crank with 5 full turns at two slews per turn). The prepared samples are of sufficient length so that during the slewing, the linen-covered Crockmeter probe head never leaves the printed surface by crossing the ink boundary and slewing onto the paper surface.

For this Crockmeter, the head weight was 934 grams, which is the weight placed on the ink during the 10-slew test, and the area of contact of the linen-covered probe head with the ink was 1.76 $cm^2$. The results of this test are obtained as described in the standard test method, by determining the optical density of the printed area before the abrasion measured on paper and the optical density of any ink left on the linen cloth after the abrasion. The difference between the two numbers is divided by the original density and multiplied by 100% to obtain the percentage of erasure resistance.

Optical Density and color Purity

To measure optical density and color purity a GRETAG SPM 50 LT meter was used. The meter is made by Gretag Limited, CH-8105 Regensdort, Switzerland. The meter has several different functions through different modes of operations, selected through different buttons and switches. When a function (optical density, for example) is selected, the measuring orifice of the meter is placed on a background, or non-imaged portion of the imaged substrate in order to "zero" it. It is then placed on the designated color patch and the measurement button is activated. The optical densities of the various color components of the color patch (in this case, Cyan (C), Magenta (M), Yellow (Y), and Black (K)) will then displayed on the screen of the meter. The value of each specific component is then used as the optical density for that component of the color patch. For instance, where a color patch is only cyan, the optical density reading may be listed as simply the value on the screen for C. Where the color patch is a combination of colors (such as Blue=Cyan+Magenta), the meter will read the optical density of the cyan that contributes to the blue patch and is expressed as C(B); that same patch would also have a magenta component, expressed as M(B).

Image Blocking Resistance

A humidity chamber (made by Thermotron Industries, Kellen Park Drive, Hollan, Mich.; model number SE-1200-5-5) is set according to the manufacturer's instructions at 58° C. and 75% relative humidity (RH) for this test. Samples for testing both adhesive (imaged portion against non-imaged portion) and cohesive (imaged portion against imaged portion) blocking are then prepared.

Cohesive blocking test: The samples are prepared by cutting printed pages into 1.25 in. squares (two printed squares are needed for each test). Plain, unprinted pages are also cut into 1.25 in. squares, two for each test. To arrange the samples for testing, two squares with printed ink on one side are placed face to face, with printed sides touching. Two squares of the plain, unprinted paper are placed, one on each (back)side of the first two squares. Multiple samples may be prepared in this way, with no more than four squares stacked per sample.

Adhesive blocking test: The samples are prepared by cutting printed pages into 1.25 in. squares (two printed squares are needed for each test). Plain, unprinted pages are also cut into 1.25 in. squares, two for each test. To arrange the samples for testing, two squares with printed ink on one side are placed front to back with one unprinted (plain paper) square, such that the printed side of one square faces one side of the unprinted (plain paper) square, and the printed side of the other printed square faces the back of the first printed square. The remaining unprinted square is placed against the back of the second printed square. Multiple samples may be prepared in this way, with no more than four squares stacked per sample.

Block Testing

Each set of samples is pre-treated for 24 hours in the humidity chamber with just a standard tongue depressor holding down each set of samples on a piece of glass. After the first 24 hours, a 1 pound weight, measuring 1 square inch is applied to the sample stack for another 24 hours. The samples are then removed, allowed to cool, and evaluated for any blocking tendencies based on pull apart sound and visible image transfer.

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97/3-4.7% w/w) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97/3-4.7//100% w/w) is made by copolymerizing the designated graft stabilizer (TCHMA/HEMA-TMI (97/3-4.7% w/w)) (S portion or shell) with the designated core monomer EMA (D portion or core, 100% EMA) at a specified ratio of D/S (core/shell) determined by the relative weights reported in the examples.

Graft Stabilizer Preparations

Example 1

A 190 liter (50 gallon) reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.48 kg (195 lb) of Norpar™ 12, by vacuum. The vacuum was then broken and a flow of 1 CFH (cubic foot per hour) of nitrogen applied and the agitation is started at 70 RPM. 30.12 kg (66.4 lb) of TCHMA was added and the container rinsed with 1.23 kg (2.7 lbs) of Norpar™ 12. 0.95 kg (2.10 lb) of 98% (w/w) HEMA was added and the container rinsed with 0.62 kg (1.37 lbs) of Norpar™ 12. Finally 0.39 kg (0.86 lb) of V-601 was added and the container rinsed with 0.09 kg (0.2 lbs) of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.050 kg (0.11 lb) of 95% (w/w) DBTDL was added to the mixture using 0.62 kg (1.37 lbs) of Norpar™ 12 to rinse container, followed by 1.47 kg (3.23 lb) of TMI. The TMI was added drop wise over the course of approximately 5 minutes while stirring the reaction mixture and the container was rinsed with 0.64 kg (1.4 lbs) of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.2% (w/w) using the drying method described above. Subsequent determination of molecular weight was made using the GPC method described above; the copolymer had a $M_w$ of 270,800 and $M_w/M_n$ of 2.58 based on two independent measurements. The product is a copolymer of TCHMA and HEMA containing random side chains of TMI and is designated herein as TCHMA/HEMA-TMI (97/3-4.7% w/w) and can be used to make an organosol.

Example 2

A 190 liter (50 gallon) reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 195 lb of Norpar™ 12, by vacuum. The vacuum was then broken and a flow of 1 CFH (cubic foot per hour) of nitrogen applied and the agitation is started at 70 RPM. 66.4 lb of TCHMA was added and the container rinsed with 2.7 lbs of Norpar™ 12. 2.10 lb of 98% (w/w) HEMA was added and the container rinsed with 1.37 lbs of Norpar™ 12. Finally 0.86 lb of V-601 was added and the container rinsed with 0.2 lbs of Norpar™12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% (w/w) DBTDL was added to the mixture using 621 g (1.37 lbs) of Norpar 12 to rinse container, followed by 1.51 kg (3.23 lb) of TMI. The TMI was added drop wise over the course of approximately 5 minutes while stirring the reaction mixture and the container was rinsed with 635 g (1.4 lbs) of Norpar™12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.2% (w/w) using the drying method described above. Subsequent determination of molecular weight was made using the GPC method described above; the copolymer had a $M_w$ of 213,500 and $M_w/M_n$ of 2.66 based on two independent measurements. The product is a copolymer of TCHMA and HEMA containing random side chains of TMI and is designated herein as TCHMA/HEMA-TMI (97/3-4.7% w/w) and can be used to make an organosol.

Table 1 summarizes the graft stabilizers compositions of Examples 1–2.

TABLE 1

Graft Stabilizers

| Example Number | Graft Stabilizer Compositions (% w/w) | Solids (wt %) | Molecular Weight $M_w$ | $M_w/M_n$ |
|---|---|---|---|---|
| 1 | TCHMA/HEMA-TMI (97/3-4.7) | 26.2 | 270,800 | 2.58 |
| 2 | TCHMA/HEMA-TMI (97/3-4.7) | 26.2 | 213,500 | 2.66 |

Organosol Preparations

Example 3

This example illustrates the use of the graft stabilizer in Example 1 to prepare an organosol with a D/S ratio of 8/1. A 2130 liter (560 gallon) reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 689.5 kg (1520 lb) of Norpar™12 and 43.86 kg (96.7 lb) of the graft stabilizer mixture from Example 1 @ 26.2% (w/w) polymer solids along with an additional 4.31 kg (9.5 lb) of Norpar™12 to rinse the pump. Agitation was then turned on at a rate of 65 RPM, and temperature was check to ensure maintenance at ambient. Next 92.1 kg (203 lb) of EMA was added along with 25.85 kg (57 lb) Norpar™12 for rinsing the pump. Finally 0.206 kg (2.28 lb.) of V-601 was added, along with 4.3 kg (9.5 lb) of Norpar™12 to rinse the container. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 80 RPM was resumed and the temperature of the reactor was heated to 75° C. and maintained for 6 hours. The conversion was quantitative.

86.2 kg (190 lb) of n-heptane and 172.4 kg (380 lb) of Norpar™12 were added to the cooled organosol. The resulting mixture was stripped of residual monomer using a rotary evaporator equipped with a dry ice/acetone condenser. Agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. The vacuum was increased to 20 torr and held for 30 minutes. At that point a full vacuum is pulled and 371.9 kg (820 lbs) of distillate was collected. Another 86.2 kg (190 lb) of n-heptane and 380 lb of Norpar™2 were added to the organosol. Agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and an additional 273.5 kg (603 lbs) of distillate was collected. The vacuum was then broken, and the stripped organosol was cooled to room temperature, yielding an opaque white dispersion.

This organosol is designated TCHMA/HEMA-TMI/EMA (97/3-4.7//100% w/w), and has a core/shell ratio of 8. The percent solid of the organosol dispersion after stripping was determined as 13.2% (w/w) using drying method described above. Subsequent determination of average particles size was made using the light scattering method described above; the organosol had a volume average diameter of 33.80 μm. The glass transition temperature was measured using DSC, as described above. The organosol particles had a $T_g$ of 68.12.

Example 4

This example illustrates the use of the graft stabilizer in Example 2 to prepare an organosol having acid functionality with a core/shell ratio of 8/1. A 5000 ml, 3-neck round flask equipped with a condenser, a thermocouple connected to a digital temperature controller, a nitrogen inlet tube connected to a source of dry nitrogen and a mechanical stirrer, was charged with a mixture of 2803 g of Norpar™ 12, 223 g of the graft stabilizer mixture from Example 2 @ 26.2% (w/w) polymer solids, 453 g of EMA, 14 g of MAA, and 7.9 of Vazo 64 were combined. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion. This organosol was designated TCHMA/HEMA-TMI//EMA/MAA (97/3-4.7//97/3), and has a core/shell ratio of 8. The percent solids of the organosol dispersion after stripping was determined to be 15.4% (w/w) using the drying method described above. Subsequent determination of average particles size was made using the laser diffraction method described above; the organosol had a volume average diameter 69 μm. The glass transition temperature of the organosol polymer was measured using DSC, as described above, was 75° C.

Example 5

This example illustrates the use of the graft stabilizer in Example 2 to prepare an organosol having basic functionality with a D/S ratio of 8/1. A 5000 ml, 3-neck round flask equipped with a condenser, a thermocouple connected to a digital temperature controller, a nitrogen inlet tube connected to a source of dry nitrogen and a mechanical stirrer, was charged with a mixture of 2.8 kg of Norpar 12,223 g of the graft stabilizer mixture from Example 2 @ 26.2% (w/w) polymer solids, 425 g of EMA, 42 g of EMAAD, and 7.9 g of Vazo 64 were combined. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion. This organosol was designated TCHMA/HEMA-TMI//EMA/EMAAD (97/3–4.7//91/9), and has a D/S1 ratio of 8. The percent solids of the organosol dispersion after stripping was determined to be 12.6% (w/w) using the drying method described above. Subsequent determination of average particles size was made using the laser diffraction method described above; the organosol had a volume average diameter 7 μm. The glass transition temperature of the organosol polymer was measured using DSC, as described above, was 76° C.

Table 2 summarizes the organosol copolymer compositions of Examples 3 to 5.

TABLE 2

Organosol Compositions

| Example Number | Organosol Compositions (% w/w) |
|---|---|
| 3 (Comparative) | TCHMA/HEMA-TMI//EMA (97/3-1.7//100) |
| 4 | TCHMA/HEMA-TMI//EMA/MAA (97/3-4.7//97/3) |
| 5 | TCHMA-HEMA-TMI//EMA/EMAAD (97/3-4.7//91/9) |

Examples 6–10

Preparation of Liquid Toner Compositions

For characterization of the prepared liquid toner compositions in these Examples, the following were measured: size-related properties (particle size); charge-related properties (bulk and free phase conductivity, dynamic mobility and zeta potential); and charge/developed reflectance optical density (Z/ROD), a parameter that is directly proportional to the toner charge/mass (Q/M).

Example 6 (Comparative)

This is a comparative example of preparing a black liquid toner at an organosol/pigment ratio of 6 using the organosol of comparative example 3. This toner does not contain wax. 234 g of the organosol @ 13.2% (w/w) solids in Norpar™2 were combined with 58 g of Norpar™12, 5 g of black pigment (Aztech EK8200, Magruder Color Company, Tucson, Ariz.) and 2.72 g of 5.67% (w/w) Zirconium HEX-CEM solution (OMG Chemical Company, Cleveland, Ohio) in an 8 ounce glass jar. This mixture was then milled in a 0.5 liter vertical bead mill (Model 6TSG-1/4, Aimex Co., Ltd., Tokyo, Japan) charged with 390 g of 1.3 mm diameter Potters glass beads (Potters Industries, Inc., Parsippany, N.J.). The mill was operated at 2,000 RPM for 50 minutes at 65° C.

A 11.9% (w/w) solids toner concentrate exhibited the following properties as determined using the test methods described above:

Volume Mean Particle Size: 4.9 micron

Q/M: 397 μC/g

Bulk Conductivity: 509 picoMhos/cm

Percent Free Phase Conductivity: 1.31%

Dynamic Mobility: 6.39E-11 ($m^2$/Vsec)

This toner was tested on the printing apparatus described previously. The reflection optical density (OD) was 1.3 at plating voltages greater than 450 volts.

Example 7 Comparative

This is an example of preparing a black liquid toner having acid functional groups without added basic functional wax at an organosol/pigment ratio of 6 using the organosol of example 4. This toner does not contain wax. 200 g of the organosol from Example 4 @ 15.4 % (w/w) solids in Norpar™12 were combined with 92 g of Norpar™12, 5 g of black pigment (Aztech BK8200, Magruder Color Company, Tucson, Ariz.) of and 2.97 g of 5.2% (w/w) Zirconium HEX-CEM solution (OMG Chemical Company, Cleveland, Ohio) in an 8 ounce glass jar. This mixture was then milled in a 0.5 liter vertical bead mill (Model 6TSG-1/4, Aimex Co., Led., Tokyo, Japan) charged with 390 g of 1.3 mm diameter Potters glass beads (Potters Industries, Inc., Parsippany, N.J.). The mill was operated at 2,000 RPM for 25 minutes at room temperature.

A 9.4% (w/w) solids toner concentrate exhibited the following properties as determined using the test methods described above:

Volume Mean Particle Size: 4.8 micron
Q/M: 189 μC/g
Bulk Conductivity: 295 picoMhos/cm
Percent Free Phase Conductivity: 1.02%
Dynamic Mobility: 2.94E-11 ($m^2$/Vsec)

This toner was tested on the printing apparatus described previously. The reflection optical density (OD) was 1.2 at plating voltages greater than 450 volts.

Example 8 Comparative

This is an example of preparing a black liquid toner having basic functional groups without added acid functional wax at an organosol/pigment ratio of 6 using the organosol of example 5. This toner does not contain wax. 245 g of the organosol @ 12.6% (w/w) solids in Norpar™12 were combined with 49 g of Norpar™12, 5 g of black pigment (Aztech BK8200, Magruder Color Company, Tucson, Ariz.) and 0.49 g of 5.2% (w/w) Zirconium HEX-CEM solution (OMG Chemical Company, Cleveland, Ohio) in an 8 ounce glass jar. This mixture was then milled in a 0.5 liter vertical bead mill (Model 6TSG-1/4, Aimex Co., Led., Tokyo, Japan) charged with 390 g of 1.3 mm diameter Potters glass beads (Potters Industries, Inc., Parsippany, N.J.). The mill was operated at 2,000 RPM for 20 minutes at room temperature.

The percent solids of the toner concentrate was determined to be 11.1% (w/w) using the drying method described above and exhibited a volume mean particle size of 2.5 microns. Average particles size measurement was made using the Horiba LA 920 laser diffraction method described above.

Volume Mean Particle Size: 2.5 micron
Q/M: 58 μC/g
Bulk Conductivity: 154 picoMhos/cm
Percent Free Phase Conductivity: 0.43%
Dynamic Mobility: 1.43E-11 ($m^2$/Vsec)

This toner was tested on the printing apparatus described previously. The reflection optical density (OD) was 1.5 at plating voltages greater than 450 volts.

Example 9

This is an example of preparing a black liquid toner derived from an organosol having acid functional groups and a basic functional wax additive at an organosol/pigment ratio of 6 using the organosol of example 4. 200 g of the organosol from Example 4 @ 15.4% (w/w) solids in Norpar™12 were combined with 93 g of Norpar™12, 9.5 g of GP-628 wax (Genesee Polymer Corporation, Flint, Mich.), 5 g of black pigment (Aztech BK8200, Magruder Color Company, Tucson, Ariz.), and 1.98 g of 5.2% (w/w) Zirconium HEX-CEM solution in an 8 ounce glass jar. This mixture was then milled in a 0.5 liter vertical bead mill (Model 6TSG-1/4, Aimex Co., Ltd., Tokyo, Japan) charged with 390 g of 1.3 mm diameter Potters glass beads (Potters Industries, Inc., Parsippany, N.J.). The mill was operated at 2,000 RPM for 95 minutes at 80° C.

A 12.4% (w/w) solids toner concentrate exhibited the following properties as determined using the test methods described above:

Volume Mean Particle Size: 4.4 micron
Q/M: 29 μC/g
Bulk Conductivity: 2.69 picoMhos/cm
Percent Free Phase Conductivity: 5.71%
Dynamic Mobility: 9.13E-12 ($m^2$/Vsec)

This toner was tested on the printing apparatus described previously. The reflection optical density (OD) was 1.1 at plating voltages greater than 450 volts.

Example 10

This is an example of preparing a black liquid toner derived from an organosol having basic functional groups and an acid functional wax additive at an organosol/pigment ratio of 6 using the organosol of example 5. 245 g of the organosol @ 12.6% (w/w) solids in Norpar™12 were combined with 40 g of Norpar™12, 5 g of black pigment (Aztech BK8200, Magruder Color Company, Tucson, Ariz.), 5.8 g of Unicid 350 wax (available from Baker Petrolite Polymers, Sugarland, Tex.), and 9.89 g of 5.2% (w/w) Zirconium HEX-CEM solution (OMG Chemical Company, Cleveland, Ohio) in an 8 ounce glass jar. This mixture was then milled in a 0.5 liter vertical bead mill (Model 6TSG-1/4, Aimex Co., Ltd., Tokyo, Japan) charged with 390 g of 1.3 mm diameter Potters glass beads (Potters Industries, Inc., Parsippany, N.J.). The mill was operated at 2,000 RPM for 40 minutes at.92° C.

The percent solids of the toner concentrate was determined to be 12.9% (w/w) using the drying method described above and exhibited a volume mean particle size of 4.1 microns. Average particles size measurement was made using the Horiba LA 920 laser diffraction method described above.

Volume Mean Particle Size: 4.1 micron
Q/M: 28 μC/g
Bulk Conductivity: 0.90 picoMhos/cm
Percent Free Phase Conductivity: 40.43%
Dynamic Mobility: 1.80E-12 ($m^2$/Vsec)

This toner was tested on the printing apparatus described previously. The reflection optical density (OD) was 1.0 at plating voltages greater than 450 volts.

Each of the liquid inks in the preceding examples and comparative examples was printed on a prototype printing device described previously. The prints were fused at varying temperatures following the procedure also described previously, as shown in the tables below. Each fused print was then tested for erasure resistance as described in the procedure section above. The results for each fused print are in the tables below.

TABLE 3

| Fusing Temperature vs. Image Erasure Resistance | | | | | |
|---|---|---|---|---|---|
| | Erasure Resistance % | | | | |
| Fusing Temp. (° C.) | Example 9-Comparative | Example 10-Comparative | Example 11-Comparative | Example 13 | Example 14 |
| 100 | 55.8 | 50 | 60 | 50 | 65 |
| 110 | 54.2 | 69.8 | 62.6 | 87.7 | 70 |
| 120 | 78.4 | 78.5 | 77.1 | 90.2 | 87.7 |
| 130 | 83.5 | 91.7 | 93.2 | 90.2 | 97.5 |
| 140 | 95.2 | 92.1 | 96.8 | 99.1 | 98.3 |
| 150 | 97.9 | 97.6 | 99 | 99.2 | 99 |
| 160 | 98.8 | 97.9 | 98.9 | 99.3 | 99.1 |
| 170 | 96.9 | 98 | 99.5 | 100 | 100 |
| 180 | 99.9 | 97.6 | 99.5 | 100 | 100 |
| 190 | 100 | 99.2 | 99.4 | 100 | 100 |
| 200 | 100 | 99.3 | 100 | 100 | 100 |

Other embodiments of this invention will be apparent to those skilled in the art upon consideration of this specification or from practice of the invention disclosed herein. All patents, patent documents, and publications cited herein are incorporated by reference as if individually incorporated. Various omissions, modifications, and changes to the principles and embodiments described herein can be made by one skilled in the art without departing from the true scope and spirit of the invention which is indicated by the following claims.

The invention claimed is:

1. A liquid electrographic toner composition comprising:

a) a liquid carrier having a Kauri-Butanol number less than about 30 mL;

b) a plurality of toner particles dispersed in the liquid carrier, wherein the toner particles comprise polymeric binder comprising at least one amphipathic copolymer comprising one or more S material portions and one or more D material portions and wherein the amphipathic copolymer has at least one acidic or basic functionality covalently bonded thereto; and c) a wax component associated with the toner particle;

wherein the wax component and the amphipathic copolymer each comprise at least one of a Lewis acid and a Lewis base pair in an amount sufficient to form weak, reversible intermolecular non-covalent bonds resulting from acid/base interactions between the wax component and the amphipathic copolymer.

2. The liquid electrographic toner composition of claim 1, wherein the wax has a melting temperature of from about 60° C. to about 140° C.

3. The liquid electrographic toner composition of claim 1, wherein the wax comprises at least one acidic functionality.

4. The liquid electrographic toner composition of claim 3, wherein the wax comprises at least one acidic functionality selected from carboxylic acid and sulfonic acid functionalities.

5. The liquid electrographic toner composition of claim 3, wherein the amphipathic copolymer comprises at least one basic functionality selected from amine, alkylamine, dialkylamine, piperidine, hydroxy, pyridine, pyridine, and pyrrolidone functionalities.

6. The liquid electrographic toner composition of claim 3, wherein the amphipathic copolymer comprises at least one basic functionality that is provided by incorporation of one or more base-functional polymerizable compounds in the amphipathic copolymer, wherein the base-functional polymerizable compound is selected from the group consisting of 2-(dimethylamino)ethyl methylate, diacetone acrylamide, acrylamide, allyl alcohol, allyl amine, allyl diethylamine, allyl ethylamine, allyl dimethylamine, allyl hydroxyethyl ether, N-allyl piperidine, p-amino styrene, diallyl amine, bis-diallylamino methane, t-butylamino methacrylate, diethylaminoethyl methacrylate, diallyl methylamine, N,N-diallylmelamine, 2-dimethylaminoethyl methacrylate, dimethylaminopropyl acrylamide, 2-dimethylamino methyl styrene, 3-dimethylamino neopentyl acrylate, 2,3-dihydroxy propyl acrylate, 2-diisopropylaminoethyl methacrylate, 4-hydroxybutyl acrylate, 4-hydroxybutyl methacrylate, 2-hydroxyethyl acrylate, 2-hydroxyethyl methacrylate, 2-hydroxypropyl acrylate, 2-hydroxypropyl methacrylate, 4-hydroxy styrene, vinyl benzene alcohol, vinyl benzene dimethylamine, 2-vinyl pyridine, 4-vinyl pyridine, N-vinyl-2-pyrrolidone and combinations thereof.

7. The liquid electrophotographic toner composition according to claim 3, wherein at least one basic functionality is bonded to the S material portion of the amphipathic copolymer.

8. The liquid electrophotographic toner composition according to claim 3, wherein at least one basic functionality is bonded to the D material portion of the amphipathic copolymer.

9. The liquid electrographic toner composition of claim 1, wherein the wax comprises at least one basic functionality.

10. The liquid electrographic toner composition of claim 9, wherein the wax comprises at least one basic functionality selected from amine, alkylamine, dialkylamine, piperidine, hydroxy, pyridine, pyridine, and pyrrolidone functionalities.

11. The liquid electrographic toner composition of claim 9, wherein the amphipathic copolymer comprises at least one acidic functionality selected from carboxylic acid and sulfonic acid functionalities.

12. The liquid electrographic toner composition of claim 9, wherein the amphipathic copolymer comprises at least one acidic functionality provided by incorporation of one or more acid-functional polymerizable compounds in the amphipathic copolymer, wherein the acid-functional polymerizable compound is selected from the group consisting of acrylic acid, 2-acrylamido-2-methyl propane sulfonic acid, crotonic acid, itaconic acid, maleic acid, methacrylic acid, pentaerythritol dimethacrylate, 2-carboxyethyl acrylate, styrene sulfonic acid, and 4-vinyl benzoic acid.

13. The liquid electrophotographic toner composition according to claim 9, wherein at least one acidic functionality is bonded to the S material portion of the amphipathic copolymer.

14. The liquid electrophotographic toner composition according to claim 9, wherein at least one acidic functionality is bonded to the D material portion of the amphipathic copolymer.

15. The liquid electrographic toner composition of claim 1, wherein the wax is associated with the polymeric binder primarily at the surface of the toner particle.

16. The liquid electrographic toner composition of claim 1, wherein the wax is associated with the polymeric binder by being substantially uniformly distributed throughout the toner particle.

17. The liquid electrophotographic toner composition according to claim 1, wherein the toner particle comprises at least one visual enhancement additive.

18. A method of making a liquid electrographic toner composition comprising:

a) providing a liquid carrier having a Kauri-Butanol number less than about 30 mL;

b) providing a plurality of toner particles dispersed in the liquid carrier, wherein the toner particles comprise polymeric binder comprising at least one amphipathic copolymer comprising one or more S material portions and one or more D material portions;

c) and providing a wax component;

wherein the wax component and the amphipathic copolymer each comprise at least one of a Lewis acid and a Lewis base pair; and d) incorporating the wax component in the toner composition in a manner to form weak, reversible intermolecular non-covalent bonds resulting from acid/base interactions between the wax component and the amphipathic copolymer, thereby associating the wax component with the toner particle.

19. The method of claim 18, wherein the wax component is incorporated in the liquid toner composition by providing the wax component during formation of the amphipathic copolymer.

20. The method of claim 18, wherein the wax component is incorporated in the liquid toner composition by providing the wax component after formation of the amphipathic copolymer, but before addition of additional adjuvants or ingredients.

21. The method of claim 18, wherein the wax component is incorporated in the liquid toner composition by providing the wax component after complete assembly and formulation of the toner particles.

* * * * *